US009528360B2

(12) United States Patent
Castillo et al.

(10) Patent No.: US 9,528,360 B2
(45) **Date of Patent: *Dec. 27, 2016**

(54) USING A COMBINATION OF A PERFORATING GUN WITH AN INFLATABLE TO COMPLETE MULTIPLE ZONES IN A SINGLE TRIP

(71) Applicant: Baker Hughes Incorporated, Houston, TX (US)

(72) Inventors: Homero C. Castillo, Kingwood, TX (US); Otto N. Fanini, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 228 days.

This patent is subject to a terminal disclaimer.

(21) Appl. No.: 14/139,960

(22) Filed: Dec. 24, 2013

(65) Prior Publication Data

US 2015/0176386 A1 Jun. 25, 2015

(51) Int. Cl.
*E21B 43/26* (2006.01)
*E21B 43/116* (2006.01)
*E21B 43/119* (2006.01)

(52) U.S. Cl.
CPC ..... *E21B 43/26* (2013.01); *E21B 43/116* (2013.01); *E21B 43/119* (2013.01); *E21B 43/261* (2013.01)

(58) Field of Classification Search
CPC ..... E21B 47/04; E21B 43/26
See application file for complete search history.

(56) References Cited

U.S. PATENT DOCUMENTS 4,105,073 A * 8/1978 Brieger ..... E21B 43/025 102/310
5,131,472 A * 7/1992 Dees ..... E21B 43/116 166/284
6,138,764 A * 10/2000 Scarsdale ..... E21B 23/08 166/117.6
6,491,098 B1 * 12/2002 Dallas ..... E21B 43/116 166/297
6,962,203 B2 * 11/2005 Funchess ..... E21B 43/08 166/263
7,059,407 B2 * 6/2006 Tolman ..... E21B 17/203 166/120
2004/0188093 A1 * 9/2004 Funchess ..... E21B 43/08 166/299

(Continued)

*Primary Examiner* — Angela M DiTrani
*Assistant Examiner* — Andrew H Sue-Ako
(74) *Attorney, Agent, or Firm* — Steve Rosenblatt

(57) ABSTRACT

A one trip system for perforating and fracking multiple intervals uses a releasable barrier. The barrier can be an inflatable. A pressure booster system is associated with the BHA so that the existing hydrostatic pressure is boosted when the gun or portions thereof are fired. After firing in one interval, the BHA is raised and the barrier is redeployed and the pattern repeats. Instruments allow sensing the conditions in the interval for optimal placement of the gun therein and for monitoring flow, pressure and formation conditions during the fracturing. Circulation between gun firings cleans up the hole. If run in on wireline a water saving tool can be associated with the BHA to rapidly position it where desired. A multitude of perforation charges mounted in the BHA can be selectively fired by selected corresponding detonator based on a predetermined sequence or surface telemetry command.

13 Claims, 10 Drawing Sheets

(56) References Cited

U.S. PATENT DOCUMENTS

| | | | | |
|---|---|---|---|---|
| 2005/0178551 | A1* | 8/2005 | Tolman | E21B 17/203 166/297 |
| 2008/0264640 | A1* | 10/2008 | Eslinger | E21B 43/128 166/308.1 |
| 2010/0236781 | A1* | 9/2010 | Mytopher | E21B 34/063 166/297 |
| 2014/0020896 | A1 | 1/2014 | Al-Gouhi | |
| 2015/0176384 | A1* | 6/2015 | Castillo | E21B 43/26 166/254.2 |
| 2015/0176385 | A1* | 6/2015 | Castillo | E21B 43/26 166/250.1 |

* cited by examiner

USING A COMBINATION OF A PERFORATING GUN WITH AN INFLATABLE TO COMPLETE MULTIPLE ZONES IN A SINGLE TRIP

FIELD OF THE INVENTION

The field of the invention is completion of a multi-interval zone and more particularly where the isolating, perforating and fracking can sequentially occur to treat the zone in a single trip in the hole.

BACKGROUND OF THE INVENTION

As wells get deeper requiring rigs with high day rates it becomes more important to streamline operations to save trips in the hole. Fracturing is a completion method that enhances subsequent production by directing high pressure fluid with high flow rates at perforations or at selectively opened ports in casing or in open hole.

In the last five years North America has changed the oil and gas markets by using horizontal drilling and multistage hydraulic fracturing to unlock the hydrocarbons in low-permeability reservoirs. These plays require new technologies that enable reservoir characterization, horizontal drilling, multistage completions, and multistage hydraulic fracturing. The purpose of a completion string is to provide the services and tools needed to turn a drilled well into a producing well. In unconventional reservoirs the completion has two primary functions. It is a way to isolate multiple stages in the wellbore and hydraulically fracture individual stages, and to provide a conduit to produce hydrocarbons through. Three completion techniques have emerged as the most effective and efficient in these types of formations; plug and-perforate, ball-activated completions (offered by Baker Hughes Inc. under the name FracPoint™), and coiled tubing-activated completions (offered by Baker Hughes Inc. under the name OptiPort™). Each of these completions has considerations.

Plug-and-Perforate

The plug-and-perforate technique typically uses cement to isolate the annulus between the open hole and the liner, perforations (perforations) to regain communication with the wellbore at the desired location, and composite frack plugs to provide through tubing isolation from the stages below. This technique starts by running pipe, called liner, into the open hole and cementing it in place. The cement hardens, and the rig is then moved off location. Because the liner is cemented in place there is no communication to the formation. Without communication tools cannot be pumped down, so the first stage perforations are run using coiled tubing, a wireline tractor, or a workover rig. The perforations penetrate though the liner and into the formation, creating an injection point for the fracture treatment. Once the first stage is perforated, the running assembly is pulled out of hole, the fracking crew rigs up, and the first stage fracture is performed through these perforations. The perforations also reestablish fluid flow into the formation, so a pump down assembly on wireline can be used for the remaining stages. From bottom to top, the pump down assembly consists of a composite frack plug, a plug setting tool, and perforation guns. All of these tools are operated by the electrical signals sent through the wireline. This assembly is pumped downhole and when it reaches the appropriate depth, a signal is sent through the wireline which sets and then releases the plug. The perforating guns are then pulled up hole to the intended perforation depth. These guns are often select-fire guns that will selectively fire sections of the guns independently. A signal is sent to fire the first section of the guns. The guns are then pulled up hole to the next perforation depth, and another signal is sent to fire the second section of the guns. This process is repeated until all of the selected depths are perforated. This technique is called cluster perforating. When the perforations for that stage are complete, the wireline is pulled out of hole, rigged down, and the fracking crew rigs up to fracture this zone. After the fracking is complete, the fracking crew rigs down and the wireline is rigged up with another pump down assembly. This process is repeated until all stages are fractured. When the fracking process is complete, the plugs are milled up and the well can be put on production.

FracPoint

The FracPoint system offered by Baker Hughes Inc. was designed to provide multistage isolation in open hole. It uses open hole packers to isolate the annulus between the open hole and the liner and ball-activated frack sleeves to divert the fracture and isolate individual stages. The frack sleeve contains a ball seat that corresponds to a frack ball. Because this system is completed in open hole and uses ball activated sleeves to divert the fracture, there are no cementing or wireline operations required. The FracPoint components are run in the hole on liner and strategically placed and spaced out to isolate and fracture the desired stages. The completion string is often hung in the well using a casing packer in the intermediate casing. A float shoe is run at the toe of the completion, and acts as a check valve to isolate the well through the liner while running in hole. Once the intended depth is reached, the first ball, which is also the smallest ball, is circulated down to the wellbore isolation valve (WIV). Once the ball seats, applying pressure closes the WIV, essentially creating a bull plug that will not allow flow through the liner from either direction. Now that the WIV is closed, the hydraulic-set packers and casing packer can be set by applying the appropriate amount of pressure. At this point the rig can be moved off of location, because the WIV provides through tubing isolation in the liner and the casing packer isolates the annulus. When the frack crew arrives and rigs up, the pressure activated sleeve (P-sleeve) is opened by simply applying the appropriate amount of pressure (which is much higher than the packer setting pressure), and the first stage fracture can begin. Once the first stage fracture is complete, a flush of clean fluid is pumped between the first and second stage to clean out any proppant that has settled in the liner. The pump rate is briefly slowed down and the ball corresponding to the second stage is dropped into the well, and pumped down the first ball activated sleeve. The balls and ball seats in the frack sleeves have different size increments with the smallest being at the toe and the largest being at the heel, so that all of the balls can pass through the other ball seats and land on the corresponding seat. When the ball lands on seat, pressuring up will shift the sleeve open, and the second stage fracture can begin. This process is then repeated until all stages are fractured. After the fracture, the ball and ball seats can be milled up, but it is not required unless a full liner diameter is needed. An alternative to the hydraulic-set open hole packer is the reactive element REPacker™ offered by Baker Hughes Inc. This packer is fluid-activated, so it is set by circulating a setting fluid over the packer and simply giving it time to swell. These can be custom made for the application depending on the pressure ratings and well parameters. Another option to consider is the re-closable CMB frack sleeves offered by Baker Hughes Inc. The CMB sleeves can be closed and reopened with a coiled tubing shifting tool. These can be used to isolate water producing stages, or used to re-isolate the liner for re-fracturing purposes.

OptiPort

The OptiPort system offered by Baker Hughes Inc. is a coiled tubing-activated multistage hydraulic fracturing completion. This system has the versatility to use either cement or open hole packers to isolate in the annulus. The OptiPort pressure-balanced frack collars provide the medium for the frack fluid to enter the selected portion of the formation, and a coiled tubing (CT) packer is used to open the frack collars and isolate through tubing from the stages below. The frack collars have internal ports that are exposed to the internal pressure of the liner. As long as both ports have the same pressure applied, the sleeve will not open. The intended collar is opened by setting a CT packer between these two pressure ports and applying annular pressure. This causes a pressure imbalance because the packer only allows the pressure to be applied to the top port, but not the bottom port. The pressure imbalance shifts open the intended collar, but the unopened collars remain pressure balanced and closed. Like the FracPoint system, the OptiPort system is run in hole and strategically spaced out on a liner string, but the liner is often ran back to surface and hung on the wellhead. Once the string reaches the setting depth, the system is cemented in place or the open hole packers are set, and the rig is moved off of location. When it comes time to fracture, a CT unit is brought out to location and the bottom hole assembly (BHA) is set up with a casing collar locator (CCL), CT packer, and circulation sub. The CT BHA is run to the bottom of the well and the CCL is used to locate the first frack collar. When the correct depth is located, the CT packer is set between the two internal pressure ports on the OptiPort collar. Pressure is applied to the CT annulus and the intended collar opens, while all other remain in a pressure-balanced and closed position, and the first stage fracture is performed through the annulus of the liner and the CT. When the frack is complete, the pumping units are shut down. Applying a pulling force on the packer releases it, and it is moved up hole to the next stage. The CCL locates the second frack collar and the CT packer is reset, pressure is applied, the second collar is opened, and the frack for this stage is performed. This process is then repeated until all stages are fractured. If there is a scenario where the fracture flow area in the CT is larger than the flow area of the annulus, the BHA can be set up to fracture down the coiled tubing.

Plug-and-Perforate Considerations

Number of stages—virtually unlimited, only limited by the length of the wireline and CT.

Stage placement—the placement of the stage is not final until the perforations are fired, sochanging the placement can be done on the fly by moving the perforating guns up or down the well.

Contingency options—there aren't any diameter restrictions above the stage being fractured, so it is possible to use through tubing tools should there be any issues.

Fracturing logistics—pressure pumping is not the only service required during the fracking operation, wireline and/or coiled tubing is needed as well.

Fracturing operation efficiency—Both pressure pumping and wireline have to be rigged up and rigged down between each stage.

Post fracture—the composite frack plugs will require mill out, but there is a full production diameter afterwards.

Re-fracturing options—straddling the perforations with through-tubing tools is the only way to provide isolation, causing a reduction in flow diameter which could limit the parameters of the re-fracture.

The flexibility of stage placement can be a huge benefit in the appraisal phase. Additional data can be gathered with logs, micro-seismic, and other tools, and the stages can be adjusted on the fly if needed.

FracPoint Conseiderations

Number of stages—the number of stages is limited to the number of ball and ball seat combinations, but technology has tightened that gap by allowing 40 ball and ball seat combinations.

Stage placement—once the system is set, the stages are fixed at the depth of the frack sleeves.

Contingency options—very limited contingency options due to diameter restrictions in the ball seats hindering the use of through tubing tools.

Fracturing logistics—Only pressure pumping required.

Fracturing operation efficiency—Nonstop fracturing operations, only showing down briefly to drop the frack ball.

Post fracture—no mill out required, but the production diameter will be restricted if the ball scats arc not removed.

Re-fracturing options—re-closable frack sleeves leave the option of completely re-isolating the liner string, providing a variety of different re-fracturing options.

The combination of improved logistics and nonstop fracturing are the big advantages with this completion system. These advantages drive efficiency during the fracture process.

OptiPort Considerations

Number of stages—virtually unlimited, only limited by the length of the CT.

Stage placement—once the system is set, the stages are fixed at the depth of the frack collars Contingency options—CT is already in hole and the BHA is set up to be able to circulate should any issues occur.

Fracturing logistics —both pressure pumping and coiled tubing required.

Fracturing operation efficiency—fracturing briefly shuts down between each stage to release the CT packer and move to the next stage Post fracture—full production diameter with no mill out required.

Re-fracturing options—straddling the perforations with through-tubing tools is the only way to provide isolation, but this was an annular frack, so the original frack parameters can most likely be matched.

Having coiled tubing in the hole while fracturing has offers several benefits. Having efficient contingency options can allow a more aggressive frack plan, because screenouts can be cleaned out with little nonproductive time. Also, it allows real time down hole pressure monitoring through the static column of fluid inside of the CT.

FIGS. 1-12 illustrate a known sequence of isolating intervals already perforated from new intervals to be perforated where the method requires a trip out of the hole every time an interval is perforated and then fractured to grab another isolation device that is then set above the recently perforated interval so that the next interval can be perforated. In FIG. 1 a perforating gun 10 is run to the bottom of the well using coiled tubing, wired tubing, wired pipe, one-trip wired drillpipe casing, wired pipe or a wireline tractor 12 and fired as shown in FIG. 2. FIG. 3 shows the guns 10 removed from the borehole 12 and the perforations 14 are then fractured by pressuring up the entire borehole 12 so as to create pathways or fractures 16 for subsequent production. Now as shown in FIG. 4 another gun 18 with a plug 20 is run in and the plug 20 is set in FIG. 5 to isolate the fractures 16 created in FIG. 3. The gun 18 is shot to make perforations 22 that are then fractured to create fractures 24. In FIG. 7 another gun 26 with a plug 28 below is run in and plug 28 is set above fractures 24. Perforations 30 are made with gun 26 and fractures 32 result from a fracturing operation as shown in FIG. 9. FIGS. 10-12 show a mill 34 sequentially milling the plugs 20 and 28 so that the borehole 12 is ready for production.

Clearly the above illustrated method has disadvantages of multiple trips into the hole and a time consuming milling operation as well as the cost of the isolation devices that are milled up. Other systems that use rupture discs and suggest a one trip multiple interval completion are discussed in U.S. Pat. No. 7,096,954.

The present invention is focused on a one trip system using guns and a releasable barrier as well as logging tool and instrumentation to allow staying in the hole after isolating a lower interval and fracturing while perforating the adjacent interval. Pressure is built up before the gun is fired in a new interval to enhance the fracture formation. Pressure is boosted at the bottom hole assembly to aid in the fracturing and for rapid deployment of the resettable barrier that is preferably an inflatable. In this manner the borehole is not fully pressurized for the fracturing. The assembly is run in with a tractor or on coiled tubing that can have an internal cable for the instrumentation that gives real time feedback as to pressure and flow conditions or seismic conditions during the fracture and powers other logging equipment so that the gun can be placed at an optimal location in any given interval. Optionally, the BHA can be pumped to the desired location using a known volume of water to minimize water consumption when pumping down the BHA on wireline, for example. Barrier milling is not required as the barrier is simply released and removed from the borehole. These and other aspects of the present invention will be more readily apparent to those skilled in the art from a review of the description of the preferred embodiment and the associated drawings while recognizing that the full scope of the invention is to be determined from the appended claims.

SUMMARY OF THE INVENTION

A one trip system for perforating and fracking multiple intervals uses a releasable barrier. The barrier can be an inflatable. A pressure booster system is associated with the BHA so that the existing hydrostatic pressure is boosted when the gun or portions thereof are fired. After firing in one interval, the BHA is raised and the barrier is redeployed and the pattern repeats. Instruments allow sensing the conditions in the interval for optimal placement of the gun therein and for monitoring flow, pressure and formation conditions during the fracturing. Circulation between gun firings cleans up the hole. If run in on wireline a water saving tool can be associated with the BHA to rapidly position it where desired. Tractors coiled tubing, wired tubing, one-trip wired drillpipe casing or wired pipe can be used in the alternative for BHA positioning. BRIEF

DESCRIPTION OF THE DRAWINGS

FIG. 4 is the view of FIG. 3 with another gun with a plug at its bottom being run in;

FIG. 7 is the view of FIG. 6 with a third gun with a plug below it being run in;

DETAILED DESCRIPTION OF THE PREFERRED EMBODIMENT

Figure 1:
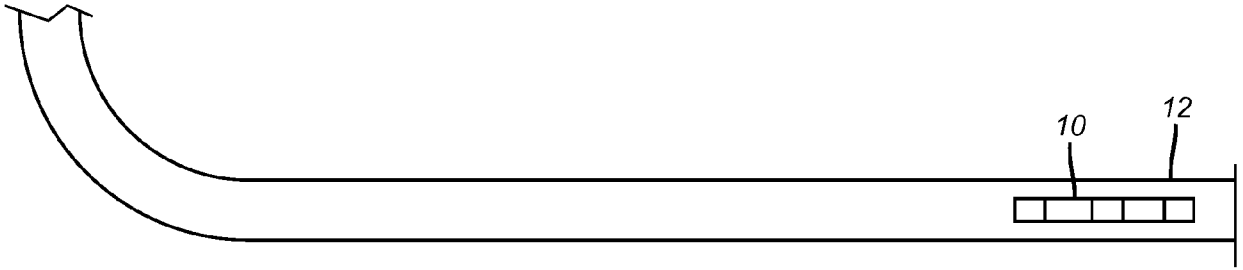
FIG. 1 is a schematic view of a prior art perforating and fracturing method showing the gun run into hole bottom for initial perforation.
Figure 2:
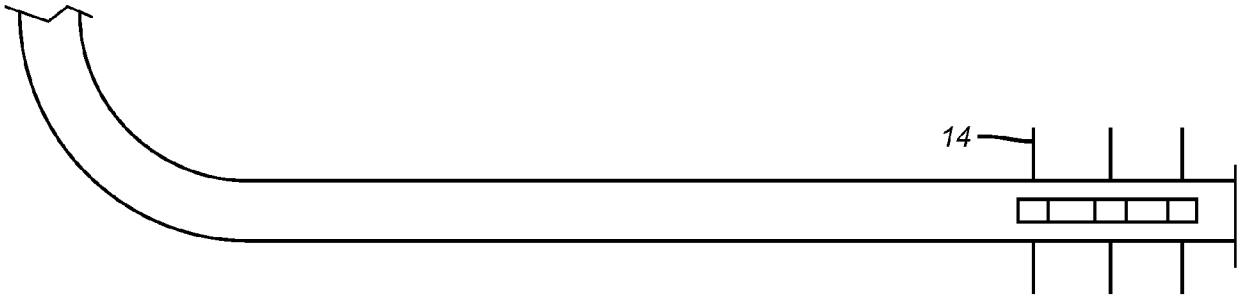
FIG. 2 is the view of FIG. 1 with the guns fired.
Figure 3:
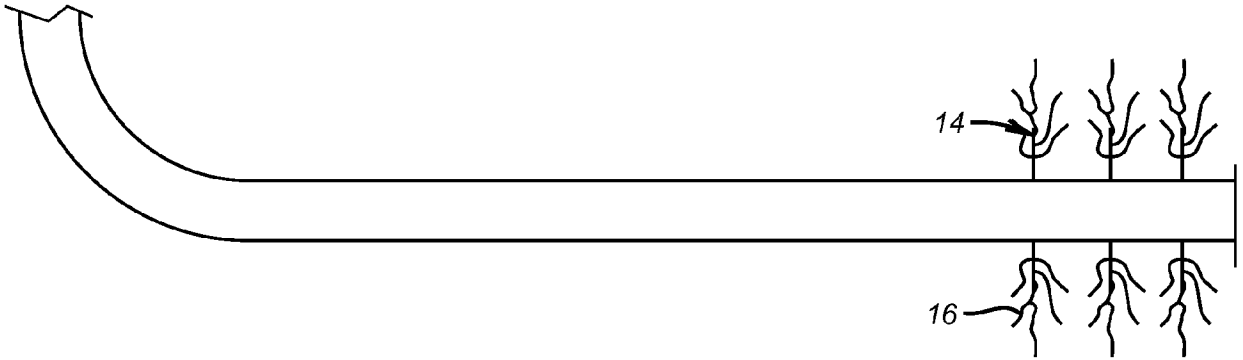
FIG. 3 is the view of FIG. 2 showing fracturing the first interval after the guns are fired.
Figure 4:
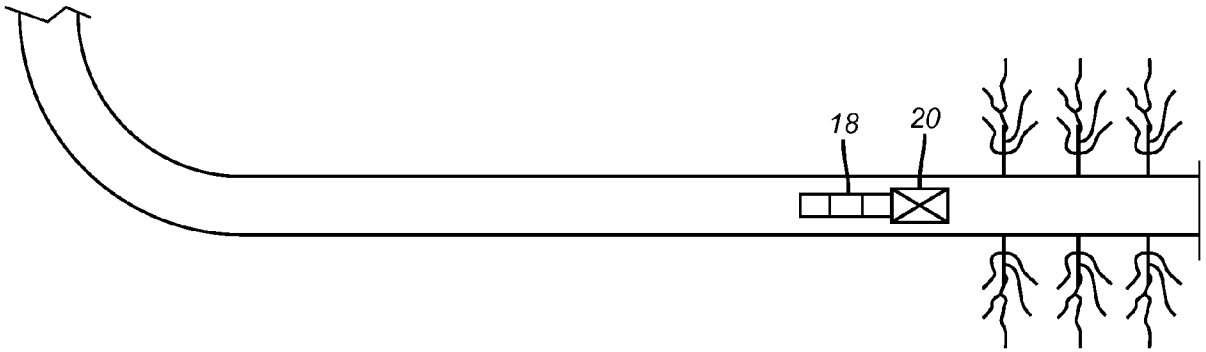
Figure 5:
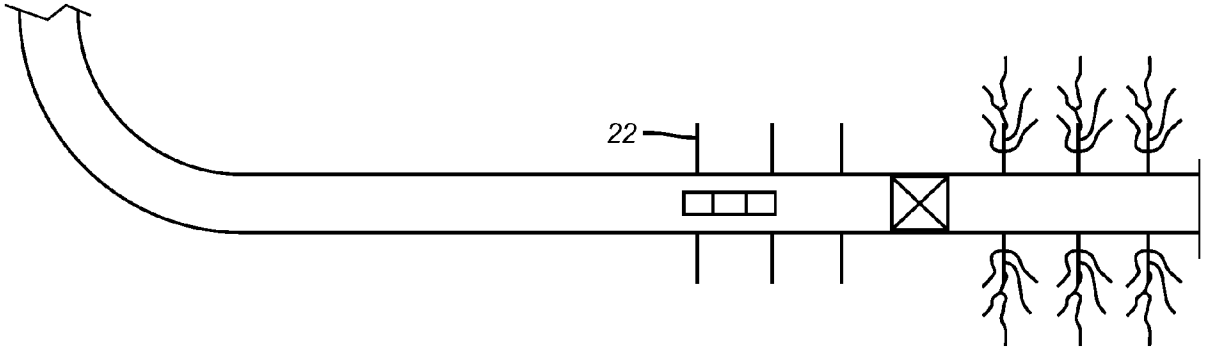
FIG. 5 is the view of FIG. 4 showing the second gun being fired.
Figure 6:
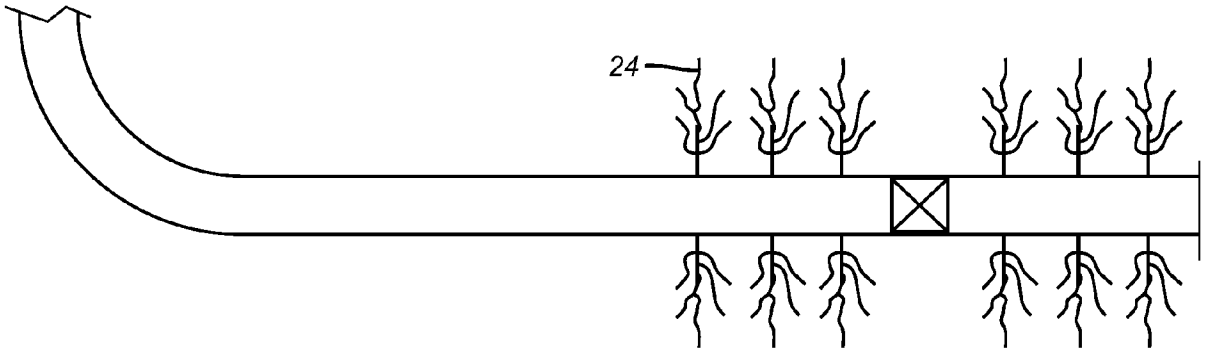
FIG. 6 is the view of FIG. 5 showing fracturing after the second gun is fired.
Figure 7:
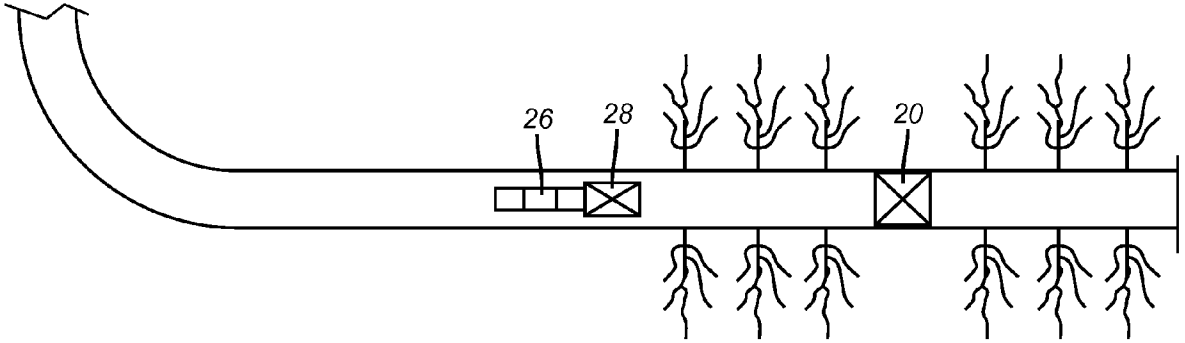
Figure 8:
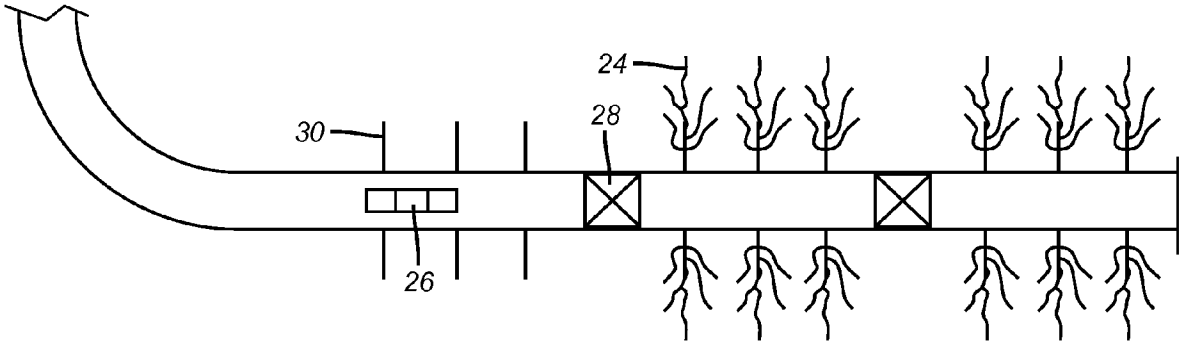
FIG. 8 is the view of FIG. 7 with perforating after setting the plug.
Figure 9:
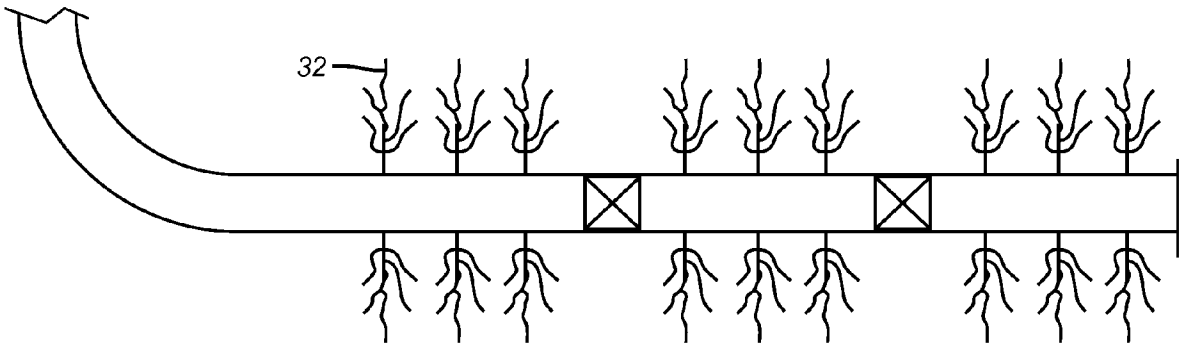
FIG. 9 is the view of FIG. 8 with the guns removed and fracking against the set plug.
Figure 10:
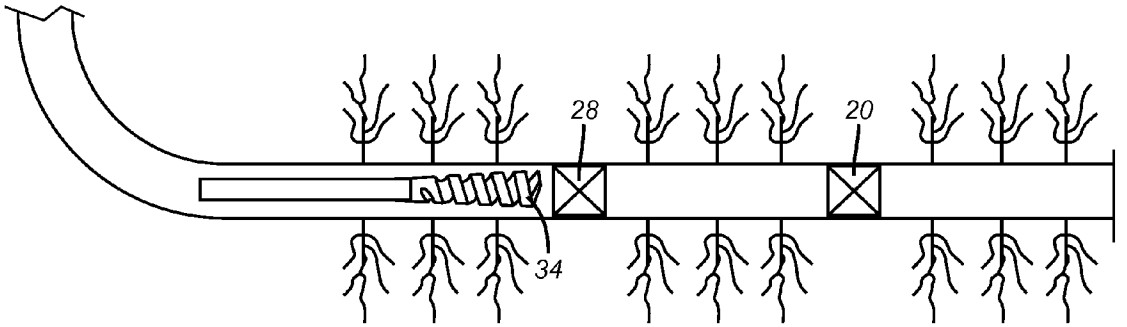
FIGS. 10-12 are the view of FIG. 9 showing the sequential milling of the previously set plugs so that the borehole is ready for production.
Figure 11:
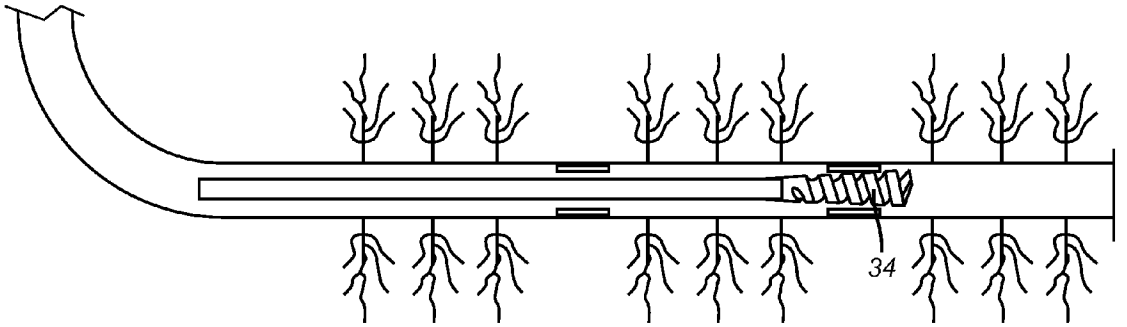
Figure 12:
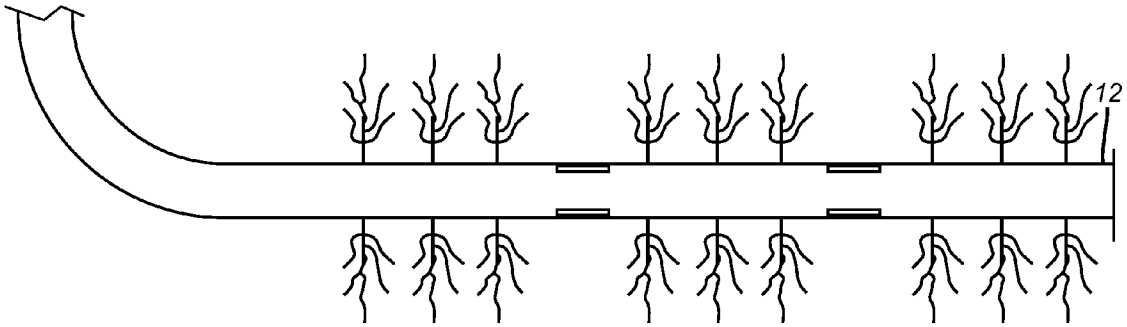
Figure 13:
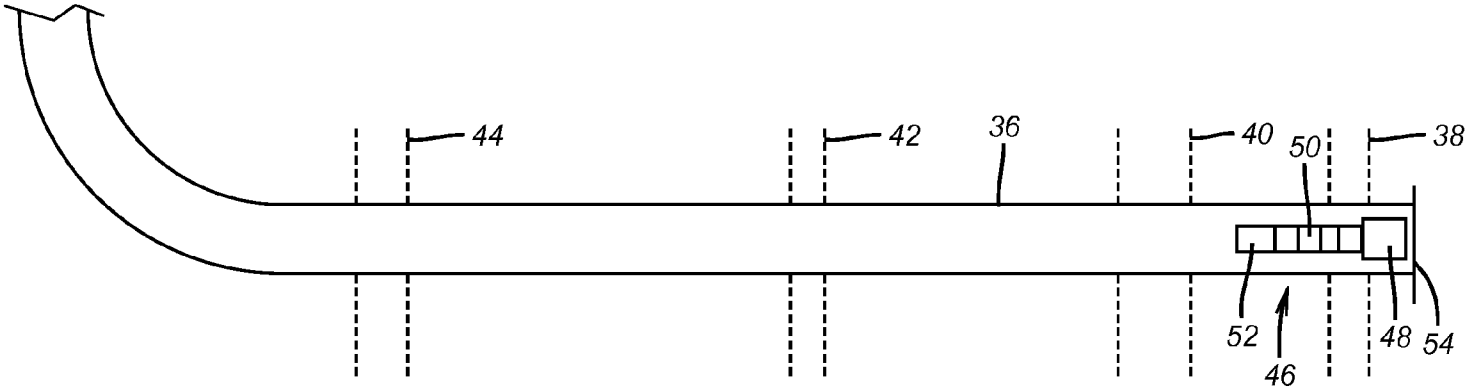
FIG. 13 is the present invention showing the BHA at hole bottom.
Figure 14:
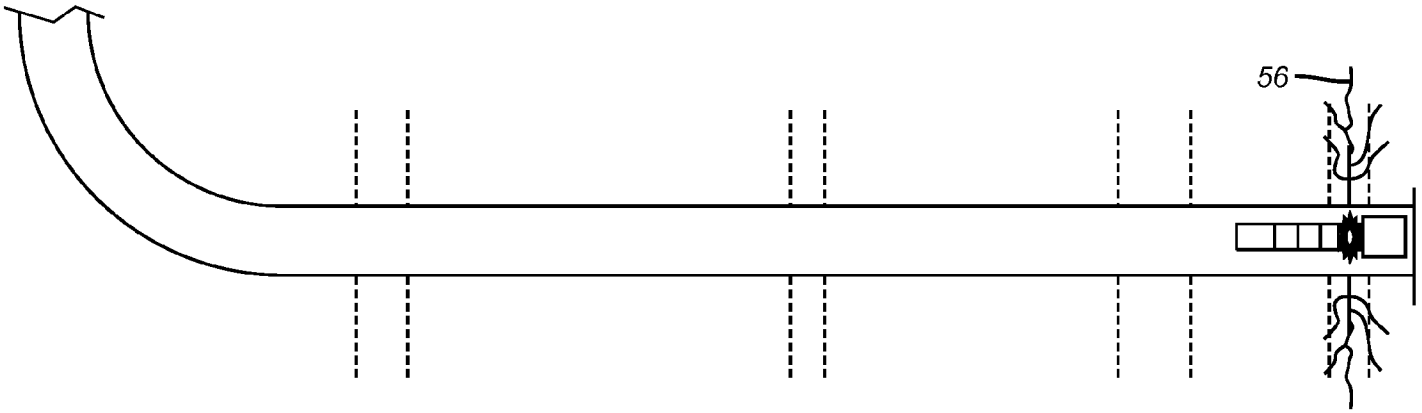
FIG. 14 is the view of FIG. 13 showing the combined pressuring up for perforation the initial time.
Figure 15:
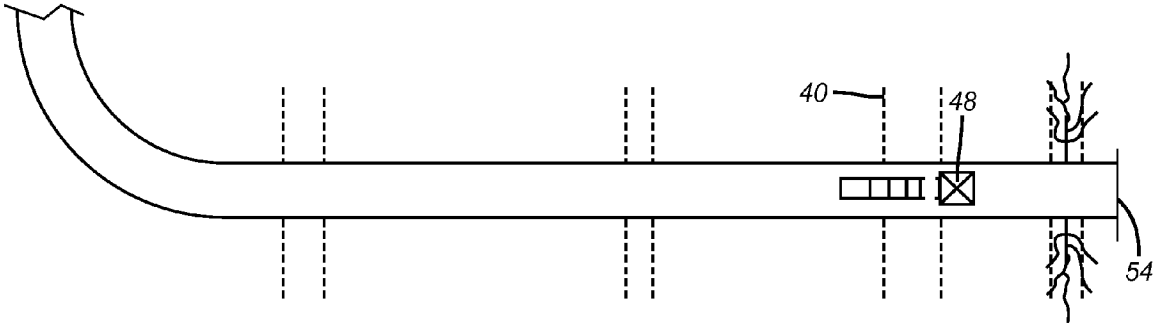
FIG. 15 is the view of FIG. 14 showing the plug repositioned above the initial perforation.
Figure 16:
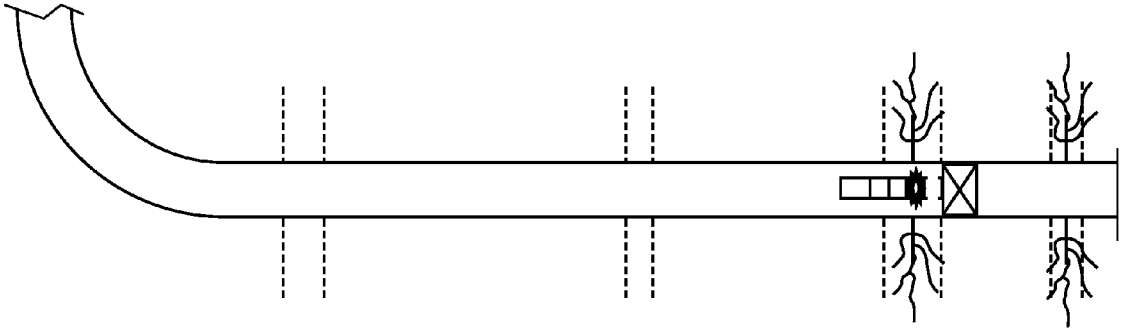
FIG. 16 is the view of FIG. 15 showing the plug set and the next interval pressured while perforated.
Figure 17:
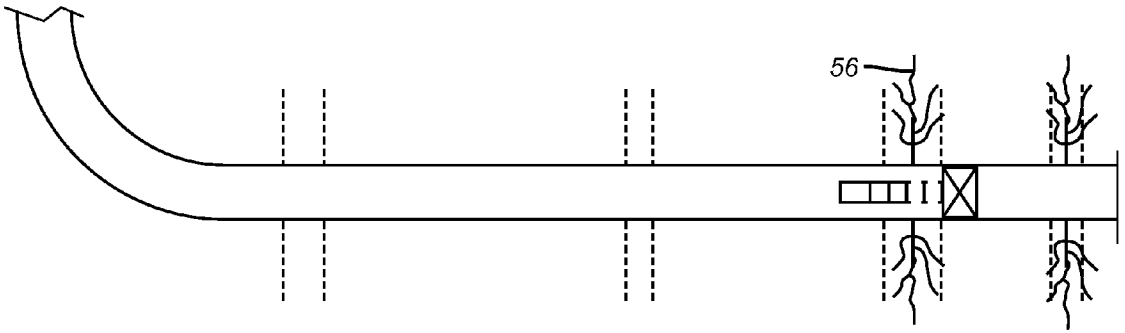
FIG. 17 is the view of FIG. 16 with the barrier released.
Figure 18:
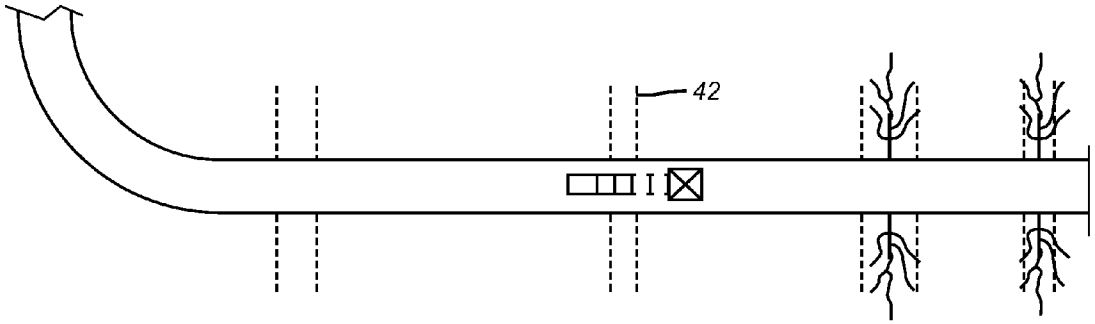
FIG. 18 is the view of FIG. 17 with the barrier repositioned uphole for perforating and fracturing at the same time.
Figure 19:
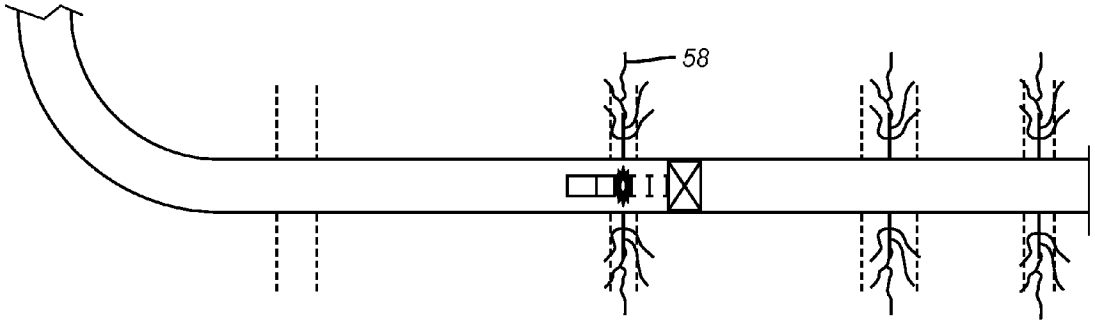
FIG. 19 is the view of FIG. 18 showing the perforating and fracturing of the next interval.
Figure 20:
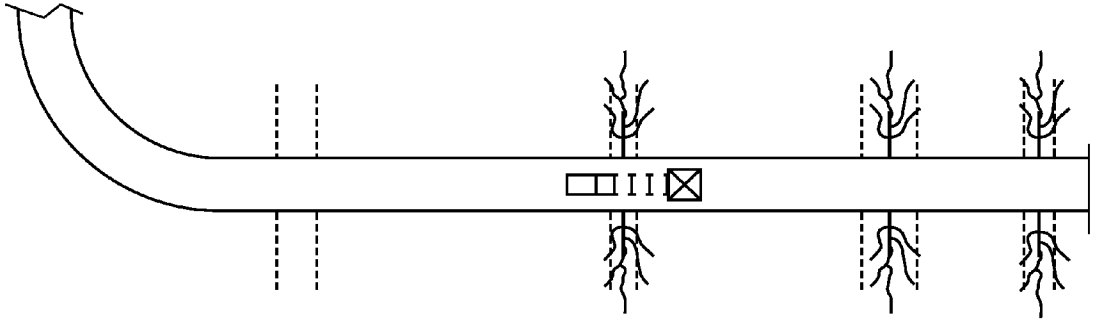
FIG. 20 is the view of FIG. 19 showing the barrier released.
Figure 21:
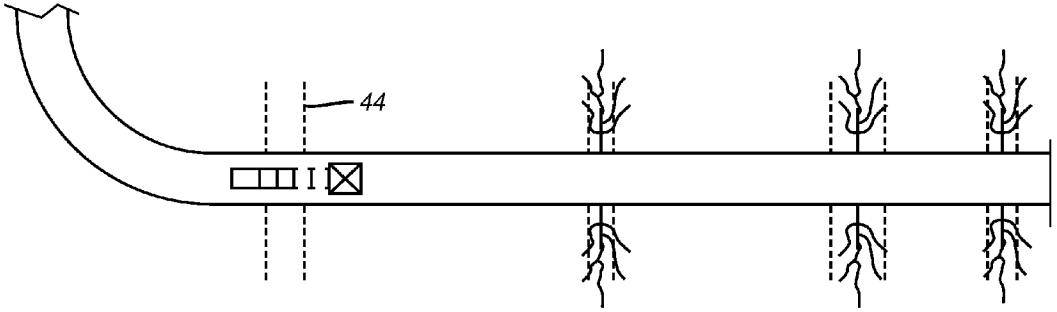
FIG. 21 is the view of FIG. 20 with the barrier repositioned above the previously made fractures.
Figure 22:
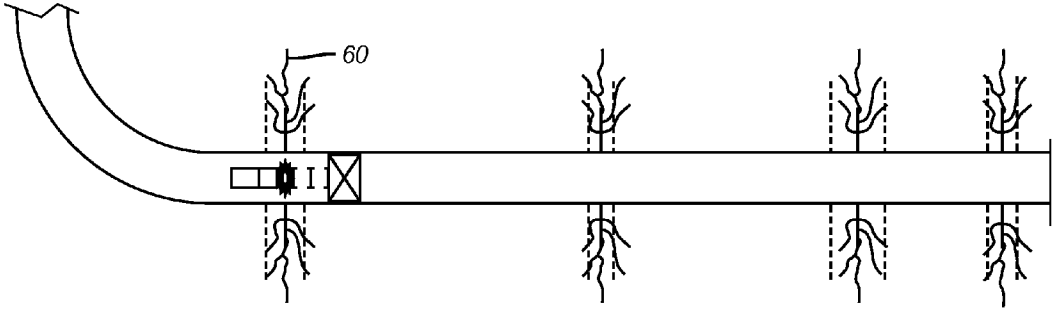
FIG. 22 is the view of FIG. 21 showing perforating and fracturing the next interval with the barrier set.
Figure 23:
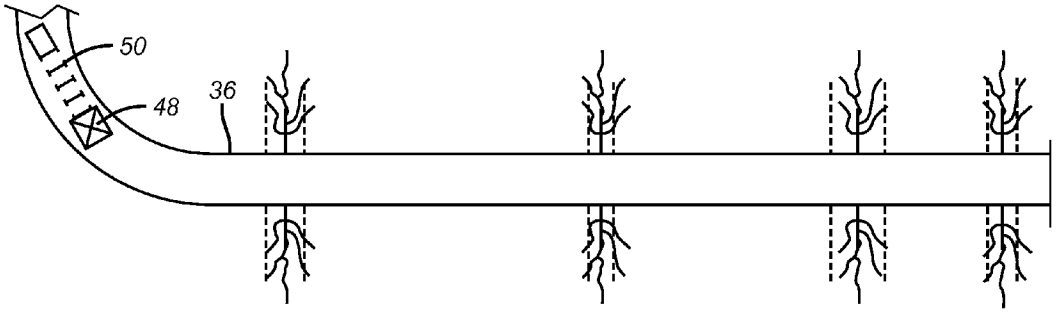
FIG. 23 is the view of FIG. 22 with the barrier removed from the borehole with the spent perforating gun.

FIG. 13 illustrates a borehole 36 with intervals 38, 40, 42 and 44 and a bottom hole assembly 46 that includes a resettable plug 48 and a multi-component gun 50 topped by a formation correlation tool 52 such as a logging tool and/or sensors for flow or pressure to be used during fracturing. Initially, the assembly 46 is run to near interval 38 at hole bottom 54. Plug 48 is not activated for the initial perforation of interval 38. The fracking fluid is spotted at the gun 50 that portion of the gun to be fired at interval 38 is pressurized with a booster system to be later described so that pressure is raised above hydrostatic in the gun 50 before the gun 50 is fired. Better fractures 56 are created from the combination of the pressurization from the booster system as the gun 50 is fired. In FIG. 15 the plug 48 which is preferably an inflatable, is released and moved uphole to just below interval 40. In FIG. 16 the plug 48 is set and the pressure is boosted as the gun 50 is fired to create fractures 56 from the high pressure and high flow rates that ensue when the gun 50 fires. The gun 50 is deflated in FIG. 17 and moved to just below interval 42 in FIG. 18. The gun 50 is inflated in FIG. 19 and again pressure is built up with the booster system and gun 50 is fired to create fractures 58 after which the plug 48 is released in FIG. 20 and repositioned next to interval 44 so the process above can be repeated to create fractures 60 after which the gun 50 and associated plug 48 are removed from the borehole, as shown in FIG. 23.

Figure 24:
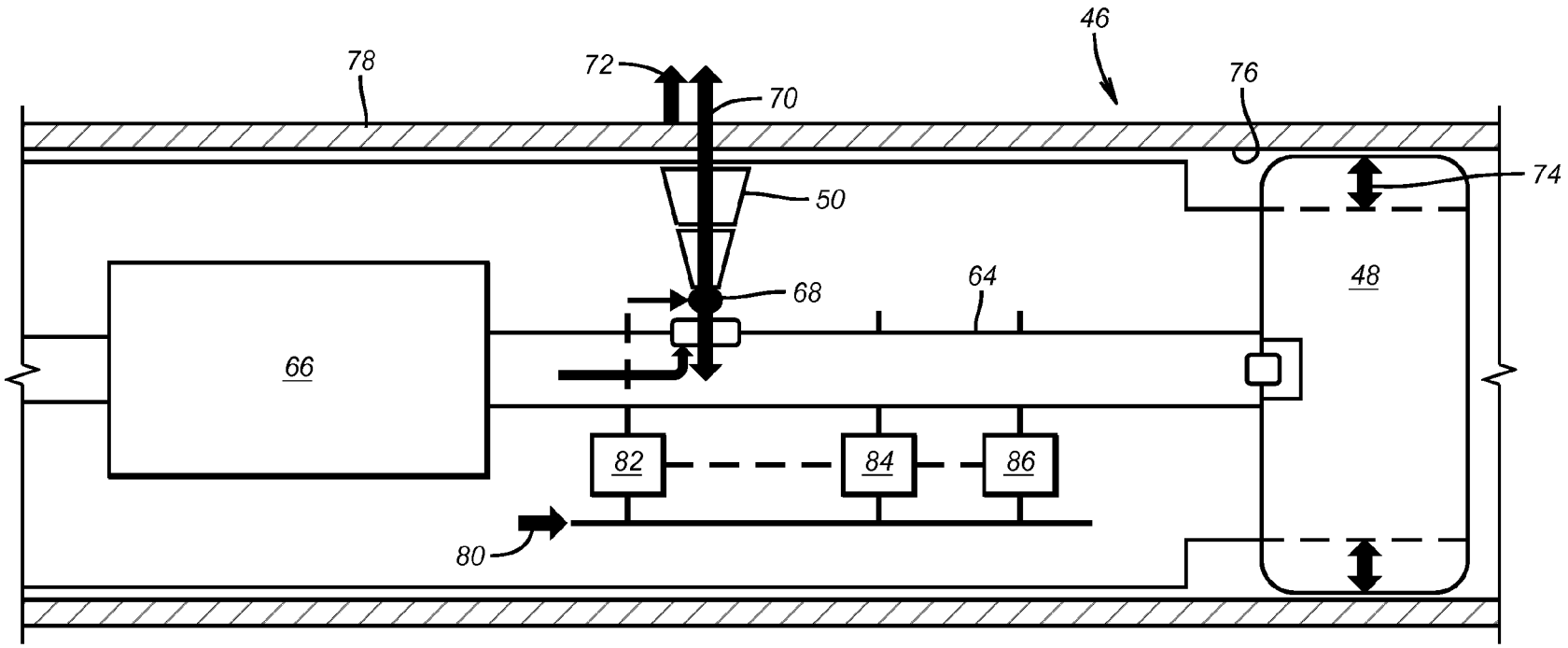
FIGS. 24 and **24*a*** are a schematic view of the pressure boost system associated with the gun and the control system for selective firing of portions of the gun as well as the inflatable barrier(s) and its connection to the pressure booster device.
Figure 24A:
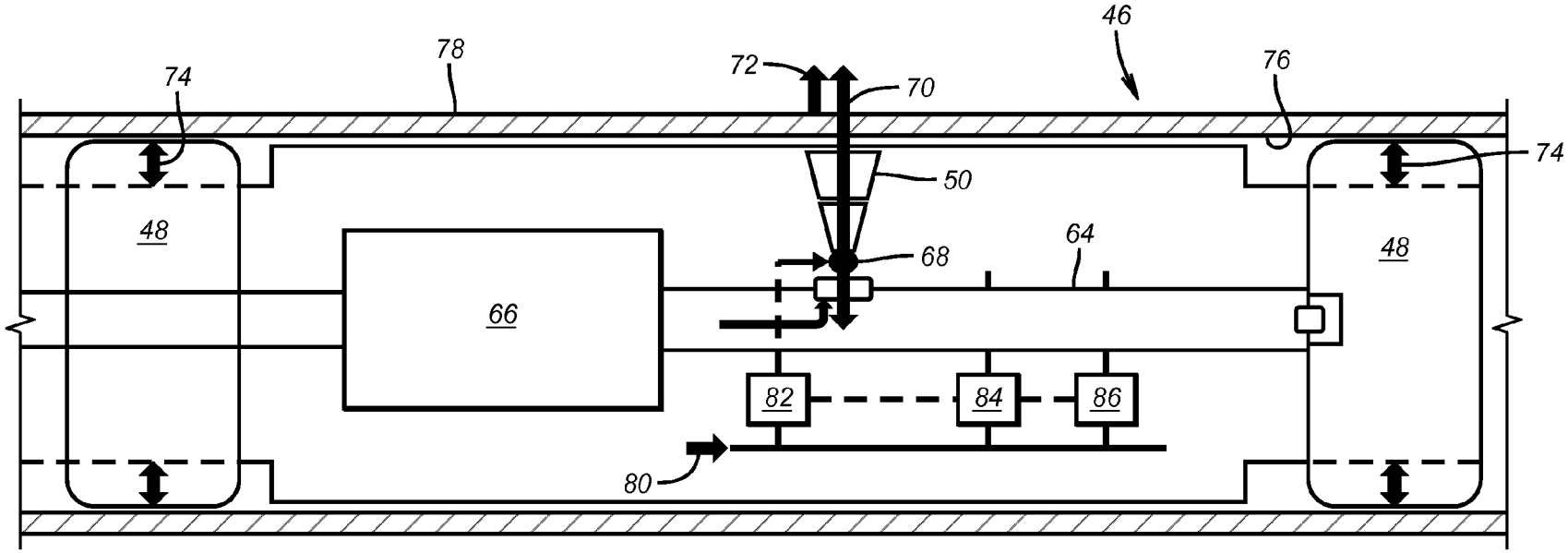

FIGS. 24 and 24*a* show schematically the assembly 46 in more detail. The inflatable plug 48 is connected to the discharge line 64 from a pressure booster assembly 66. Assembly 66 can be a pump operated with power from a wireline that delivers assembly 46 or from a cable that extends through coiled tubing that delivers assembly 46. Igniter 68 is used to fire gun 50 resulting in a release of force from the shooting of the gun that is schematically illustrated by arrow 70. At the same time, the boosted hydrostatic pressure as a result of the use of booster 66 delivers a high pressure pulse combined with high flow rates from surface pumping through now opened passages through gun 50 as a result of its being fired as well as direct flow from the borehole into the perforations. This is represented by arrow 72. Arrows 74 schematically represent how the inflatable(s) 48 grows in diameter to seal off against the inside wall 76 of casing 78. Arrow 80 represents a communication/power cable that powers a controller 82 to determine what portions of the gun 50 are to be fired at each location. Items 84 and 86 represent instruments or logging tools that provide real time data at the surface of conditions close to the fracking location including such data as pressure, temperature and flow rate to give some examples. The gun 50 is configured to punch out back plates to allow the pressurized fracking fluid to rush into the perforating tunnels to intensify creation and propagation of fractures in the rock. The pressure booster of FIGS. 24 and 24*a* optionally in a separate scenario to be chosen not to be used. The fracking pressure would be provided from the surface and the well would be controlled by mud weight and therefore being over balanced to hold back fracked zones' reservoir producing pressures as the well is progressively fracked during the well fracking program.

Those skilled in the art will appreciate that the assembly 46 can be run in on wireline and advanced with a tractor or with an articulated peripheral seal that allows a volume of fluid behind the seal to be pumped to advance the assembly 46 with a minimum of pumped fluid. In between firings of gun 50 when the assembly is delivered on coiled tubing, circulation can take place to clean up the borehole of residual proppant delivered as part of the fracturing operation. Other advantages of the method of the present invention are the one trip nature of the process that accomplishes isolation, perforation and fracturing of multiple intervals in a single trip. The plug is resettable so that no milling is necessary when all the intervals have been treated. The effectiveness of the fracturing is enhanced with pressure buildup into the gun as it is fired so that the high pressure fluid at high volumes can rush through the gun and into the perforations as they are made by the firing of the gun. If delivered on wireline the BHA can be positioned with minimal water consumption by using a peripheral articulated seal and pumping water behind it to reach a desired location. Logging tools with the assembly 46 allow pinpoint location of the gun 50 in a given interval based on real time data. This can be a very advantageous feature in re-fracturing applications. The assembly 46 can be delivered on coiled tubing with an interior cable for signal or power supply functions. The coiled tubing allows better control of the BHA in pushing and pulling maneuvers as compared to small outside diameter wirelines. Seismic sensors can be employed in the assembly 46 for monitoring of the fracking operation.

The BHA contains multitude of charges and corresponding detonators selectively activated from the surface or following a pre-programmed operational sequence, therefore detonating simultaneously or in a prescribed sequence to take advantage of the operational efficiency benefits introduced by this invention. A charge or group of charges can be selectively detonated in the operational sequence at each fracking station isolated by the retractable pressure sealing packer for the combined perforation and fracking operation which can be done in sequence, simultaneously or overlapping in time soon after perforation is developed. Alternatively an upper sealing retractable packer could be deployed on top of the BHA allowing perforating and fracking in any sequence along the well or in different fracking events or BHA trips downhole during the production life cycle of a fracked well possibly targeting a secondary well or a reservoir re-fracking stimulation. A pressure booster could pressurize the fracking fluid volume between the upper and lower retractable packers deployed with the BHA. This pressure booster could operate under telemetry control which could be wireline, pressure pulse, dropped or pumped down balls triggering a prescribed or pre-programmed operational sequence.

Before the initial fracking of the well select the well zones to be isolated perforated and fracked applying this invention method using either or both cased well and open hole formation evaluation log analysis to determine well zones which are economically attractive with sufficient production potential after being fracked by this invention method. This well zone selection analysis is conducted optionally assisted and jointly interpreted with seismic data obtained either in the surface or borehole. The selected well zones to be fracked could be isolated with the lower upper and or lower retractable packers. The reservoir could be characterized by other deep measurements like borehole seismic and surface seismic, deep transient Electromagnetic (EM) survey (surface and borehole), and during the reservoir production phase after fracking program is completed gravity measurements (Surface and borehole gravity measurements).

During well re-fracking operation targeted to stimulate production and either increase or restore secondary production levels identify and prioritize well fracked zones lacking production with potential for re-fracking of infill-fracking intervals between previously fracked well locations. Selection and prioritization of well zones for re-fracking based on cased hole production logging tool to determine the zones initially fracked which are producing below targeted levels and need to be re-fracked to re-stimulate and increase fracked well production.

The above description is illustrative of the preferred embodiment and many modifications may be made by those skilled in the art without departing from the invention whose scope is to be determined from the literal and equivalent scope of the claims below:

We claim:

1. A one trip perforating and fracturing method for multiple intervals, comprising:

in a first interval, isolating an explosives bearing gun from another portion of a borehole with at least one inflatable, by inflating the inflatable at a location adjacent said first interval;

boosting wellbore hydrostatic pressure in said gun before firing explosives in said gun with a booster device mounted near said gun before firing explosives in said gun;

firing explosives occupying a first space in said gun to initially create perforations in said first interval;

flowing a pulse of said boosted pressure from said booster device to pass through said first space previously occupied by said explosives;

pumping fluid through said gun through said first space previously occupied by said explosives and into the perforated first interval to fracture said first interval;

deflating said inflatable and repositioning said deflated inflatable by at least one other interval;

repeating said above steps at least one time by at least a second of said intervals by firing previously unfired explosives occupying a second space, then performing said pumping through said second space.

2. The method of claim 1, comprising:

removing said gun and said inflatable for production from at least one said interval without borehole milling.

3. The method of claim 1, comprising:

pumping to boost hydrostatic pressure to said gun when said gun is fired.

4. The method of claim 1, comprising:

creating fluid passages in said gun for said fracturing due to firing said gun.

5. The method of claim 1, comprising:

delivering said gun and plug with wireline or coiled tubing or both.

6. The method of claim 1, comprising:

providing a peripheral seal for said bottom hole assembly;

driving said assembly to the subterranean location with a predetermined fluid volume.

7. The method of claim 1, comprising:

producing a pressure pulse through said gun as it is fired with a pressure boost device associated with said bottom hole assembly.

8. The method of claim 1, comprising:

providing at least one sensor to measure at least one borehole condition;

transmitting said measured condition to a surface location;

locating said gun in a given said interval based on said measured condition, for fracture formation from said perforating and fracturing.

9. The method of claim 8, comprising:

providing multiple sensors for additionally measuring conditions during said fracturing for optimizing said fracturing.

10. The method of claim 9, comprising:

measuring at least one of pressure, flow rate and temperature during said fracturing.

11. The method of claim 8, comprising:

locating said gun based on said measured condition for re-fracturing in locations spaced from previously fractured intervals.

12. The method of claim 1, wherein:

providing spaced inflatables as said at least one inflatable;

locating said gun between said spaced inflatables.

13. A one trip perforating and formation fracturing method for multiple intervals, comprising:

in a first interval of the formation, isolating an explosives bearing gun from another portion of a borehole with at least one inflatable, by inflating said inflatable;

perforating said first interval by firing explosives occupying a first space in said explosives bearing gun while boosting wellbore hydrostatic pressure with a booster device mountable near said gun, wherein the explosives occupying said first space are not fired until after the wellbore hydrostatic pressure in said gun has been boosted such that the firing of the explosives occupying said first space initiates the perforations and wherein any pulse generated from said booster device by the boosting of the hydrostatic pressure is capable of passing through said first space previously occupied by said explosives;

fracturing the formation with fluid pumped into the perforated first interval through said first space previously occupied by said explosives;

wherein another interval of the formation may be perforated and fractured by deflating and repositioning said inflatable by at least one other interval and repeating the above steps with explosives in a second space in said explosives bearing gun thereby pumping fluid through the second space previously occupied by said explosives in said second space.

* * * * *